US011814897B2

(12) United States Patent
Chiquin

(10) Patent No.: US 11,814,897 B2
(45) Date of Patent: Nov. 14, 2023

(54) OPERATING ASSEMBLY AND SYSTEM FOR A ROLLER SHADE

(71) Applicant: Vertilux Limited, Medley, FL (US)

(72) Inventor: Edwin Chiquin, Miami, FL (US)

(73) Assignee: VERTILUX LIMITED, Medley, FL (US)

( * ) Notice: Subject to any disclaimer, the term of this patent is extended or adjusted under 35 U.S.C. 154(b) by 60 days.

(21) Appl. No.: 17/359,540

(22) Filed: Jun. 26, 2021

(65) Prior Publication Data

US 2022/0412163 A1 Dec. 29, 2022

(51) Int. Cl.
*E06B 9/72* (2006.01)
*E06B 9/42* (2006.01)

(52) U.S. Cl.
CPC . *E06B 9/72* (2013.01); *E06B 9/42* (2013.01)

(58) Field of Classification Search
CPC ..... E06B 9/72; E06B 9/42; E06B 9/60
See application file for complete search history.

(56) References Cited

U.S. PATENT DOCUMENTS

| | | | |
|---|---|---|---|
| 2,549,905 | A | 4/1951 | Jablon |
| 3,297,075 | A | 1/1967 | Howell et al. |
| 3,402,421 | A | 9/1968 | Weber |
| 3,417,519 | A | 12/1968 | Hitter |
| 3,454,073 | A | 7/1969 | Man |
| 4,122,559 | A | 10/1978 | Kelly |
| 4,197,896 | A | 4/1980 | Reichstadt |
| D259,810 | S | 7/1981 | Dallaire |
| D260,183 | S | 8/1981 | Dallaire |
| D271,055 | S | 10/1983 | Cascone et al. |
| 4,840,216 | A | 6/1989 | John |
| 4,935,988 | A | 6/1990 | Ford et al. |
| 4,987,943 | A | 1/1991 | Charest |
| 5,137,073 | A | 8/1992 | Huang |
| 5,232,039 | A | 8/1993 | Shapiro et al. |

(Continued)

FOREIGN PATENT DOCUMENTS

| | | |
|---|---|---|
| AU | 2009203048 | 10/2015 |
| BG | 6230-0011 | 9/2006 |

(Continued)

OTHER PUBLICATIONS

Bing Search, http://www.quebanana.com/tienda/ver/herrajesmarino/145224, Aug. 22, 2013.

(Continued)

*Primary Examiner* — Beth A Stephan
(74) *Attorney, Agent, or Firm* — MALLOY & MALLOY, PL

(57) ABSTRACT

An operating assembly for a roller shade including a shade mount rotationally connected to the roller shade concurrent to movement thereof between lowered and raised orientations. A bracket assembly interconnects opposite ends the shade mount and a supporting surface and a drive assembly, a drive unit and an idler unit, is interconnected between the bracket assembly and the shade mount in rotationally driving relation to said shade mount. The bracket assembly includes at least one bracket disposed in supporting interconnection between said drive unit and a support surface and structured for supporting interconnection with different types of drive units.

16 Claims, 13 Drawing Sheets

(56) References Cited

U.S. PATENT DOCUMENTS 5,259,687 A 11/1993 John
5,271,687 A 12/1993 Holka et al.
D345,498 S 3/1994 Fraser et al.
5,296,964 A 3/1994 Shopp
5,330,821 A 7/1994 Lo
D353,209 S 12/1994 Dallaire et al.
D355,094 S 2/1995 Josephson
D355,604 S 2/1995 De Baschmakoff
D382,651 S 8/1997 Colitto
D382,652 S 8/1997 Colitto
5,803,144 A 9/1998 Ives
D405,194 S 2/1999 Kenkel
5,924,255 A 7/1999 Vagedes
5,975,186 A 11/1999 Day
D429,588 S 8/2000 Smederod
6,111,694 A 8/2000 Shopp
6,173,825 B1 1/2001 Liu
6,196,508 B1 3/2001 Nijs
6,202,967 B1 3/2001 Fraczek
D440,099 S 4/2001 Hortsen
6,230,782 B1 5/2001 Reichert
6,234,233 B1 5/2001 Biro
6,269,909 B1 8/2001 Grimes et al.
6,408,922 B2 6/2002 Desrochers
D468,453 S 1/2003 Schrader
6,532,109 B1 3/2003 Shopp
D479,934 S 9/2003 Colson et al.
6,666,251 B2 12/2003 Ikle
D489,209 S 5/2004 Goldberg
6,739,373 B1 5/2004 Liu et al.
D492,809 S 7/2004 Weitgasser
D494,401 S 8/2004 Davies et al.
6,817,399 B2 11/2004 Berman et al.
6,817,402 B1 11/2004 Fraczek et al.
7,048,028 B2 5/2006 Wolfe et al.
D530,967 S 10/2006 Smith
7,141,164 B2 11/2006 Slack et al.
7,168,475 B2 1/2007 Colson et al.
D537,173 S 2/2007 Westphal et al.
7,195,052 B2 3/2007 Nien et al.
D542,068 S 5/2007 Watkins et al.
7,210,513 B2 5/2007 Goldenberg et al.
D557,116 S 12/2007 Zakowski
7,353,857 B2 4/2008 Koop
7,367,536 B1 5/2008 Anderson et al.
7,380,582 B1 6/2008 Anderson et al.
D573,267 S 7/2008 Brinton et al.
D577,138 S 9/2008 Kitagawa et al.
D591,442 S 4/2009 Ford et al.
D596,435 S 7/2009 Wills
D599,051 S 8/2009 Wu et al.
D604,885 S 11/2009 Ford et al.
D616,567 S 5/2010 Desrosiers et al.
D616,568 S 5/2010 Desrosiers et al.
D634,573 S 3/2011 Risher
7,921,602 B2 4/2011 Ohanesian
7,997,041 B2 8/2011 Slack et al.
D652,568 S 1/2012 Trzesniowski
8,136,569 B2 3/2012 Bohlen et al.
8,220,520 B2 7/2012 Lukos
D675,050 S 1/2013 Garcia
D680,357 S 4/2013 Wills et al.
8,480,048 B2 7/2013 Krantz-Lilienthal
8,528,623 B2 9/2013 Roberts
D691,398 S 10/2013 Chou
D694,039 S 11/2013 Licciardi Di Stefano
D694,040 S 11/2013 Di Stefano
8,584,317 B2 11/2013 Liebscher et al.
D695,042 S 12/2013 Licciardi Di Stefano
D697,335 S 1/2014 Dekker et al.
D699,976 S 2/2014 Chou
D710,128 S 8/2014 Garcia
D715,629 S 10/2014 Grubb et al.
8,960,621 B2 2/2015 Wills
D727,659 S 4/2015 Kao
9,004,142 B2 4/2015 Marocco
9,038,696 B2 5/2015 Lava et al.
9,060,636 B2 6/2015 Cannaverde
D740,589 S 10/2015 Ng
9,175,512 B2 11/2015 Lu et al.
D753,933 S 4/2016 Ng
D759,400 S 6/2016 Watkins
D762,398 S 8/2016 Ng
9,498,079 B2 11/2016 Sanchuk
D775,939 S 1/2017 Ng
D780,945 S 3/2017 Guillemi
D789,454 S 6/2017 Prisnie
D791,580 S 7/2017 Chou
D798,133 S 9/2017 Ng
D808,684 S 1/2018 Santilli
D808,685 S 1/2018 Raiti
D822,228 S 7/2018 Wang et al.
D828,052 S 9/2018 Bouroullec et al.
D833,175 S 11/2018 Miroshnichenko et al.
D843,130 S 3/2019 Bacal
10,309,153 B2 6/2019 McPherson et al.
D854,192 S 7/2019 Rokvic
D854,855 S 7/2019 Garcia Garcia
D854,856 S 7/2019 Garcia Garcia
10,407,905 B2 9/2019 Neal
D866,221 S 11/2019 Chiquin
10,544,621 B2 1/2020 Mocanu et al.
10,619,412 B2 4/2020 Chen et al.
D885,084 S 5/2020 Chiquin
D911,064 S 2/2021 Holt et al.
D936,388 S 11/2021 Schwandt et al.
D938,190 S 12/2021 Tan
D940,477 S 1/2022 Chiquin
11,332,974 B2 5/2022 Chiquin
D954,467 S 6/2022 Chiquin
D955,140 S 6/2022 Garcia Garcia
D955,141 S 6/2022 Garcia Garcia
D958,563 S 7/2022 Bouroullec et al.
D970,254 S 11/2022 Chiquin
D982,351 S 4/2023 Bacal
D987,886 S 5/2023 Wang et al.
D994,389 S 8/2023 Bouroullec et al.
D996,372 S 8/2023 Hu
2003/0178276 A1 9/2003 Fraczek et al.
2004/0129391 A1 7/2004 Gottschall et al.
2004/0182522 A1 9/2004 Strand et al.
2005/0247413 A1 11/2005 Nien et al.
2005/0269044 A1 12/2005 Nien
2006/0000559 A1 1/2006 Bohlen
2006/0049325 A1 3/2006 Jung
2006/0086874 A1* 4/2006 Habel ..... E06B 9/72 248/268
2006/0113046 A1 6/2006 Prince et al.
2006/0243402 A1 11/2006 Chang
2007/0169900 A1 7/2007 Chen et al.
2007/0221344 A1 9/2007 Beach et al.
2007/0284051 A1 12/2007 Grimes et al.
2008/0035281 A1 2/2008 Kirby
2008/0121353 A1* 5/2008 Detmer ..... E06B 9/90 160/311
2008/0245489 A1 10/2008 Chuang et al.
2009/0229767 A1 9/2009 Mullet et al.
2009/0250177 A1 10/2009 Byeon
2009/0258752 A1 10/2009 Bohlen et al.
2010/0101741 A1 4/2010 Koop
2010/0175838 A1 7/2010 Faller et al.
2010/0300631 A1 12/2010 Sullivan
2011/0006176 A1 1/2011 Krantz-Lilienthal
2011/0114809 A1 5/2011 Ng
2012/0012262 A1 1/2012 Santoro et al.
2012/0031572 A1 2/2012 Ng et al.
2012/0255686 A1 10/2012 Huang
2013/0048229 A1 2/2013 Dwarka
2013/0068405 A1 3/2013 Lava et al.
2013/0098563 A1 4/2013 Jang
2013/0176743 A1 7/2013 Pfund et al.
2014/0048218 A1 2/2014 Ng
2014/0166218 A1 6/2014 Ng
2014/0251558 A1 9/2014 Chou

(56) References Cited

U.S. PATENT DOCUMENTS

| | | | | |
|---|---|---|---|---|
| 2014/0262076 | A1 | 9/2014 | Mullet et al. | |
| 2014/0305602 | A1 | 10/2014 | Kirby et al. | |
| 2014/0352897 | A1 | 12/2014 | Mullet et al. | |
| 2015/0027059 | A1 | 1/2015 | Lu et al. | |
| 2015/0047792 | A1 | 2/2015 | Lukosiunas et al. | |
| 2015/0240851 | A1 | 10/2015 | Giacometti et al. | |
| 2015/0275571 | A1 | 10/2015 | Guhl | |
| 2015/0297014 | A1 | 10/2015 | Cannaverde | |
| 2015/0368970 | A1 | 12/2015 | Chambers et al. | |
| 2016/0051074 | A1 | 2/2016 | Chou | |
| 2016/0090779 | A1 | 3/2016 | Nurre et al. | |
| 2016/0298375 | A1 | 10/2016 | Wagner et al. | |
| 2016/0326800 | A1 | 11/2016 | Marocco | |
| 2016/0340972 | A1 | 11/2016 | Chou | |
| 2017/0079459 | A1 | 3/2017 | Filko | |
| 2017/0114593 | A1 | 4/2017 | Hebeisen et al. | |
| 2018/0087319 | A1 | 3/2018 | McPherson et al. | |
| 2018/0310745 | A1* | 11/2018 | Giri | A47H 1/13 |
| 2018/0313147 | A1* | 11/2018 | Krantz-Lilienthal | E06B 9/78 |
| 2019/0186198 | A1* | 6/2019 | Kirby | E06B 9/78 |
| 2019/0249488 | A1* | 8/2019 | Campagna | E06B 9/48 |
| 2019/0352963 | A1 | 11/2019 | Jang | |
| 2020/0052515 | A1 | 2/2020 | Nien et al. | |
| 2020/0095825 | A1 | 3/2020 | Chen et al. | |
| 2020/0185965 | A1* | 6/2020 | Poirier | G03B 21/56 |
| 2020/0284093 | A1* | 9/2020 | Dahlgren | E06B 9/62 |
| 2021/0131179 | A1* | 5/2021 | Campagna | H03K 17/962 |
| 2021/0222490 | A1* | 7/2021 | Campagna | E06B 9/42 |
| 2021/0310299 | A1 | 10/2021 | Chiquin | |
| 2022/0003041 | A1* | 1/2022 | Graybar | E06B 9/90 |

FOREIGN PATENT DOCUMENTS

| | | |
|---|---|---|
| BG | 6230-0016 | 9/2006 |
| BR | 3020120013798 | 2/2013 |
| BR | 3020120056900 | 3/2016 |
| CN | 2012300548304 | 3/2013 |
| CN | 2012303568969 | 4/2013 |
| CO | 07051520 | 5/2007 |
| CO | 282 | 7/2012 |
| EM | 000113899-0003 | 4/2003 |
| EM | 000275839-0002 | 12/2004 |
| EM | 000279633-0001 | 1/2005 |
| EM | 000518923-0001 | 4/2006 |
| EM | 000795752-0001 | 9/2007 |
| EM | 001084370-0013 | 2/2009 |
| EM | 001102875-0002 | 3/2009 |
| EM | 0013369940001 | 7/2012 |
| EM | 003342013-0012 | 8/2016 |
| GB | 2052622 | 12/1995 |
| GB | 2391577 | 2/2004 |
| MX | 38640 | 5/2013 |
| PE | 002031-2018 | 1/2019 |
| WO | WOD068016-0004 | 6/2006 |
| WO | WOD086931-0004 | 6/2015 |

OTHER PUBLICATIONS

Rollashade, Rollashade Contract Series, Feb. 5, 2018.

Rolleaseacmeda, System Quick Reference Guide; https://www.rolleaseacmeda.com/docs/default-source/default-document-library/edge-side-channels_qrg_us_v1-0.pdf?sfvrsn=0&sfvrsn=0, Feb. 5, 2018.

* cited by examiner

OPERATING ASSEMBLY AND SYSTEM FOR A ROLLER SHADE

BACKGROUND OF THE INVENTION

Field of the Invention

The present invention is directed to an operating system and attendant assembly for a roller shade including a shade mount rotationally driven by a drive assembly. A bracket assembly is structured to interconnect either a manually or electrically powered drive assembly to a supporting surface.

Description of the Related Art

Window treatments of various types are used both domestically and commercially throughout most industrialized countries of the world. Such known and/or conventional window treatments include, but are not limited to, drapes, curtains, shutters, blinds, shades, etc.

Perhaps one of the most common forms of window treatment includes shade structures, or more specifically roller shades, comprising a flexible material fabric, film, etc. initially stored in surrounding relation to a supporting, cylindrical roller. The roller is rotationally mounted generally at the top end or edge of the window and the flexible material shade is rolled downwardly, from the supporting roller, into covering relation with the window. The shade, when in its operative, shading orientation is generally dimensioned to cover substantially the entirety of the window for purposes of restricting light and viewing through the window.

The popularity of such roller shades is due, at least in part, to their comparatively low cost, ease of operation and effectiveness in providing the desired or required amount of shade. Further the flexible shade material utilized can vary significantly in both size, configuration and decorative features.

Other features incorporated within such a conventional roller shade may include the ability to further restrict light passing through the window by movably positioning the edges of the shade into side channels connected to or integrated within the longitudinal sides of the window frame. When such side channels are used, light is prevented or significantly restricted from passing between the opposite longitudinal edges of the flexible material shade and the correspondingly disposed sides of the window frame.

Additional structural and operative features associated with this type of window treatment may include the use of a bottom rail or weight bar dimensioned and structured to be connected to a bottom free end and/or edge of the shade. The bottom rail is utilized to help extend the shape and extend or remove any wrinkles in the fabric, thereby positioning it in its intended overlying, covering and shading orientation relative to at least a majority of the window.

The popularity of roller type shades of the type described has led to innovations relating to different types of drives serving to raise or lower the roller shade as desired, More specifically, such different types of drives commonly include a manual drive, wherein a pull cord/chain drives at least one and of the roller shade support in opposite directions to facilitate the aforementioned raising and lowering thereof. In contrast, it is also known to have electrically powered drive assemblies for rotating the roller shade support structure in opposite directions and thereby "automatically" raise or lower the roller shade absent manual intervention with a pull cord, of the type set forth above.

However, using the different types of manual or powered drive assemblies sometimes complicates the support of the overall roller shade on a supporting surface. As is well known, roller shades of the type described may be mounted on a ceiling or other substantially horizontal support surface. In the alternative, roller shade assemblies may be mounted on a wall or other substantially vertical support surfaces. Such a versatile mounting typically requires the use of different types of mounting or support components thereby adding to the cost and complications of production and installation. Further, it is also known to have different mounting or support components, dependent on whether the drive assembly is manually or electrically powered.

Therefore, there is a need in the art and industry associated with window treatments and in particular flexible material roller shade structures, for support assemblies, such as a bracket assembly having one or more brackets capable of being disposed in different or variable operative orientations. Such a proposed operating system and assembly for a roller shade would be of benefit by including supporting components, including brackets which are capable of being mounted on different transversely oriented support surfaces such as, but not limited to a ceiling surface and/or a wall surface. Such versatile operative orientations of a bracket assembly would be accomplished using a commonly structured bracket rather than requiring different brackets for installation on different support surfaces. Further, an improved operating system and assembly for a roller shade structure should incorporate at least one bracket of a bracket assembly which is also capable of supporting interconnection with different type drive units or drive assemblies including the aforementioned manual drive assembly and electrically powered drive assembly.

SUMMARY OF THE INVENTION

The present invention is directed to an operating system and its attendant operating assembly for a roller shade. Structural and operative features of different preferred embodiments of the operating assembly facilitate the roller shade being driven between lowered and raised positions, either manually or by an electrically powered motor.

The operating assembly includes a shade mount on which the roller shade is movably connected and supported in a rolled-about fashion. In conventional terms, rotation of the shade mount in different directions facilitates the roller shade being either lowered or raised. A bracket assembly is disposed in interconnecting relation between opposite ends of the shade mount and a supporting surface. Each of the aforementioned preferred embodiments of the present invention include the bracket assembly having at least two brackets each attached or interconnected to a different one of the opposite ends of the shade mount. A drive assembly is interconnected between the bracket assembly and the shade mount in rotationally driving relation to the shade mount. As such, the drive assembly includes a drive unit and an idler unit, each rotationally connected to a different, opposite end of the shade mount and each connected in supporting relation to a supporting surface by a different one of the aforementioned at least two brackets of the bracket assembly.

The bracket assembly, including each of the at least two oppositely disposed brackets are structured to assume variable operative orientations as they support opposite ends of the shade mount and operatively interconnect the drive unit and the idler unit to the shade mount. More specifically, the variable operative orientations of the bracket assembly and the aforementioned oppositely disposed brackets include the shade mount being supported by and interconnected to differently oriented support surfaces typically disposed in perpendicular and/or transverse relation to one another. By way of nonlimiting practical example, the variable orientations of the brackets of the bracket assembly include their supporting engagement with either a ceiling surface or a wall surface. This is accomplished by changing or reorienting the disposition of both the two oppositely disposed brackets substantially 90° into what may be accurately described as a "horizontal" orientation or a "vertical" orientation.

Accordingly, each of the oppositely disposed brackets of the bracket assembly include a base and an attachment segment disposed in transverse and/or more specifically perpendicular relation to the base and extending outwardly therefrom. The base of each of the two brackets is dimensioned and configured to be fixedly secured to different ones of the aforementioned drive unit and idler unit. The attachment segment, dependent on the orientation/position of the bracket to which it is attached will be secured to one of the transversely oriented ceiling or wall support surfaces. Therefore, when the operating assembly is intended to be connected to and supported by a wall surface rather than a ceiling surface, the bracket is effectively rotated 90° such that the attachment segment will be disposed in direct confronting engagement with the substantially vertically oriented wall surface rather than the substantially horizontally oriented ceiling surface. It is of course recognized that the ceiling and wall surfaces are not meant to be described herein as being disposed in a true horizontal or vertical orientation. Further, the term "ceiling surface" is meant to describe the surface serving as the interior ceiling of a room or area. In the alternative, this term may also be descriptive of a substantially horizontal surface such as, but not limited to the interior of a window casing.

As set forth above, different preferred embodiments of the operating assembly of the present invention accomplish raising and lowering of the roller shade by either a manual drive or an electrically powered drive of the shade mount. The manual drive includes the drive unit being in the form of a manual clutch assembly operatively interconnected to a pull cord/chain connected in driving engagement to a rotating disk as part of the aforementioned clutch assembly. In contrast, the electrically powered embodiment includes a drive motor connected to the shade mount and having a corresponding end thereof connected to an interface unit which in turn is fixedly connected to at least one of the correspondingly positioned brackets of the bracket assembly. Therefore, one distinguishing feature of the present invention is the inclusion of at least one of the two oppositely disposed brackets being interconnected to the drive unit, wherein the drive unit may include the aforementioned manually driven clutch assembly or electric drive motor. As a result, at least one distinguishing feature is the dimensioning, configuring and the overall structuring of at least one of the two opposite brackets of the bracket assembly, to accommodate connection to either of the different types of manual or electrically powered input units.

As will be described in greater detail hereinafter, the versatile structuring of the at least one bracket fixedly secured to the drive unit includes a mounting tab fixedly and/or integrally secured to the base of the bracket and extending transversely outward therefrom into supporting engagement with the different type drive units including the manual clutch or electric motor interface associated therewith. For purposes of cost-saving, the other of the at least two oppositely disposed brackets of the bracket assembly may be substantially structured for supporting interconnection of the idler unit and may be used with a manually or electrically powered operating assembly.

While the aforementioned drive unit may be of different types by being manually or electrically powered, another advantageous and distinguishing feature of the operating assembly of the present invention is the universal structuring of the idler unit to be used with either of the different types of drive units. As such, the drive unit comprises a drive pin disposed in rotating engagement with the correspondingly disposed end of the shade mount. Further, the drive pin includes a "spring-loaded" construction structured to facilitate reciprocal disposition of the drive pin relative to the shade mount. Such reciprocal disposition of the drive pin occurs in a direction substantially coaxial to the length thereof and/or the length of the shade mount.

The spring-loaded construction further includes an adjustment member disposed and structured to regulate and/or determine the reciprocal disposition of the mounting pin. In at least one embodiment the adjustment member may have a predetermined irregular peripheral configuration structured to facilitate manual engagement and attendant selective movement of the adjustment member and the mounting pin to accomplish a preferred reciprocal disposition (inward or outward relative to the shade mount). This may facilitate the attachment of the shade mount concurrently to both the power unit, regardless of its type, and the idler unit. The irregular peripheral surface of the adjustment member may also facilitate the utilization of a common or customized tool to engage and rotate/move the adjustment member when manual engagement there with is not practical or preferred.

Yet additional distinguishing features of one or more embodiments of the operating assembly of the present invention include the provision of a leveling assembly. The leveling assembly may be connected to the mounting or end pin and may or may not be considered an operative component of the idler unit. Further, the leveling assembly is operative to regulate and establish a substantially level disposition of the assembled operating assembly and rotationally attached roller shade in its mounted position, whether supported by the ceiling surface or wall surface. The substantially level disposition is accomplished by an adjustment of the assembled operating assembly in a substantially vertical direction. Such an initial non-level disposition of the installed operating assembly may be due, at least in part, to a ceiling or other horizontally oriented support surface itself not being truly level or horizontal as normally intended.

Yet additional features structurally and operatively associated with each of the embodiments of the operating assembly include the provision of at least a frontal fascia. The frontal fascia preferably includes a generally L-shaped configuration including a vertically oriented surface overlying the front portion of the assembled shade mount, bracket assembly, drive assembly, etc. in addition, the L-shaped configuration includes a transverse and/or perpendicular bottom segment disposed in covering relation to a normally exposed bottom area of the assembled operating assembly as indicated above. It is to be noted that in certain practical installations, a "blackout" condition may be desired, wherein the passage of external light into the interior of the portal and about peripheral portions of the corresponding roller shade is blocked or at least partially restricted. Such a "blackout" condition may be at least partially accomplished through the provision of a rear fascia cooperatively disposed with the frontal fascia to at least partially enclose the operating system about at least three sides. The operative and structural features associated with both the frontal fascia and rear fascia allows their snap-fit construction into intended position, in at least partially surrounding and/or enclosing relation to the installed operating system, as set forth herein.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
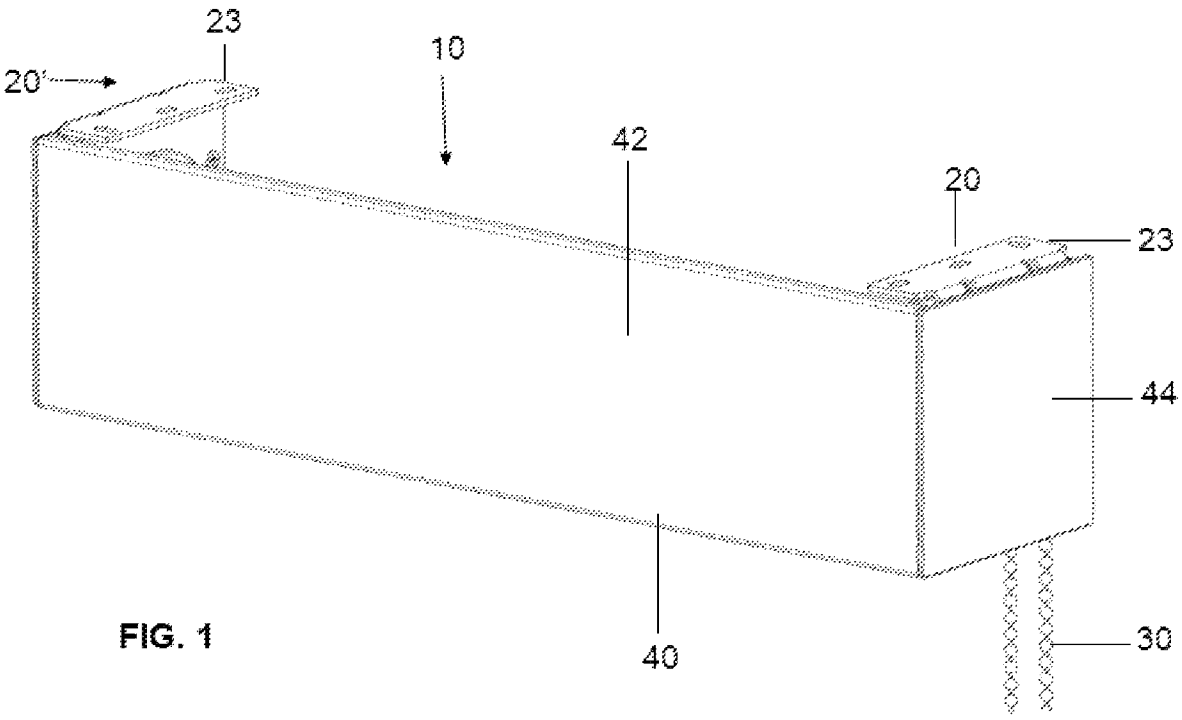
FIG. 1 is a perspective view in partially assembled form of the operating assembly for a roller shade of the present invention.
Figure 2:
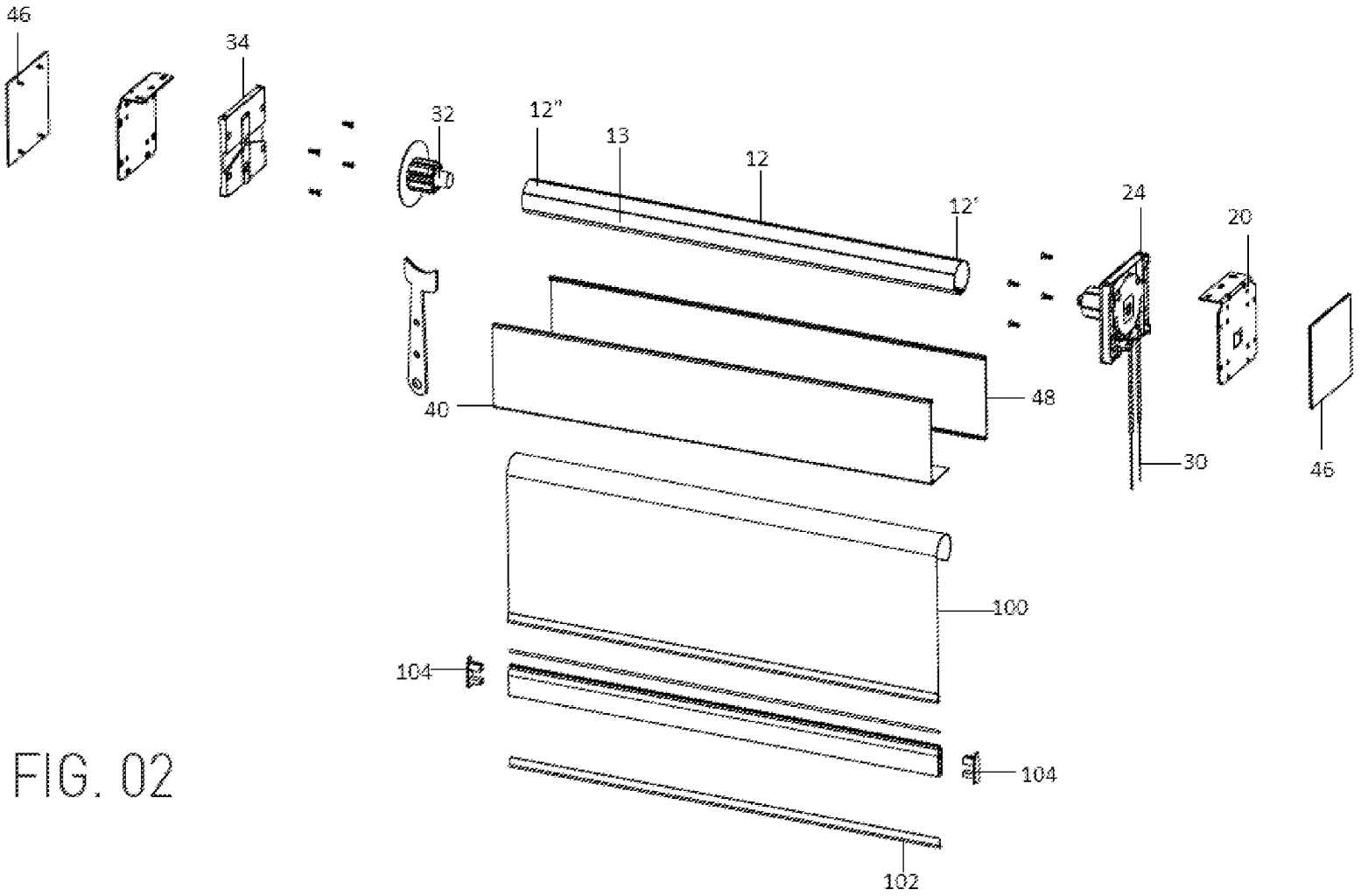
FIG. 2 is a perspective view in exploded form of the embodiment of FIG. 1.

As represented in the accompanying Figures, the present invention is directed to a system and an attendant assembly 10 and 10', respectively disclosed in FIGS. 1-10 and FIGS. 11-13, for operating a roller shade, generally indicated as 100. Structural and operative features of the different preferred embodiments of the operating assembly 10 and 10' facilitate the roller shade 100 being driven between lowered and raised positions, either manually, as with the embodiment of FIGS. 1-10, or by an electrically powered motor, as with the embodiment of FIGS. 11-13. The roller shade structure 100, as represented in FIGS. 2 and 11, may include a material of sufficient flexibility to be rotationally mounted on, such as being rolled upon, a shade mount 12. Further, the roller shade structure 100 may include a bottom rail or end bar 102, which is connected at opposite ends by end caps or closure members 104.

As also represented in FIGS. 1-10, the roller shade operating assembly 10, includes the shade mount 12, movably supporting the roller shade 100, and a drive assembly generally indicated as 14, Also, in at least one embodiment, such as represented in FIG. 2, the shade mount 12 includes a plurality of elongated ribs or like structures 13 extending along at least a portion of a length thereof. The drive assembly 14 comprises a drive unit 16 represented in assembled form in FIG. 3 and in a detailed exploded form in FIG. 5. The drive assembly 14 also includes an idler unit 18 represented in assembled form in FIG. 4 and in a detailed exploded form in FIG. 6. In conventional terms, rotation of the shade mount 12 and roller shade 100 in different directions (up and down) facilitates the roller shade 100, being either raised or lowered, via operation of the drive assembly 14. As explained in greater detail hereinafter, a bracket assembly includes at least two brackets 20 and 20' interconnected between a supporting surface (not shown) and correspondingly disposed opposite ends 12' and 12" of the shade mount 12, via the drive unit 16 and the idler unit 18 respectively. Also, member 46 may cover and/or overlie the exterior portions of the bracket 20 (see FIG. 2) and bracket 20' (see FIG. 11).

Figure 3:
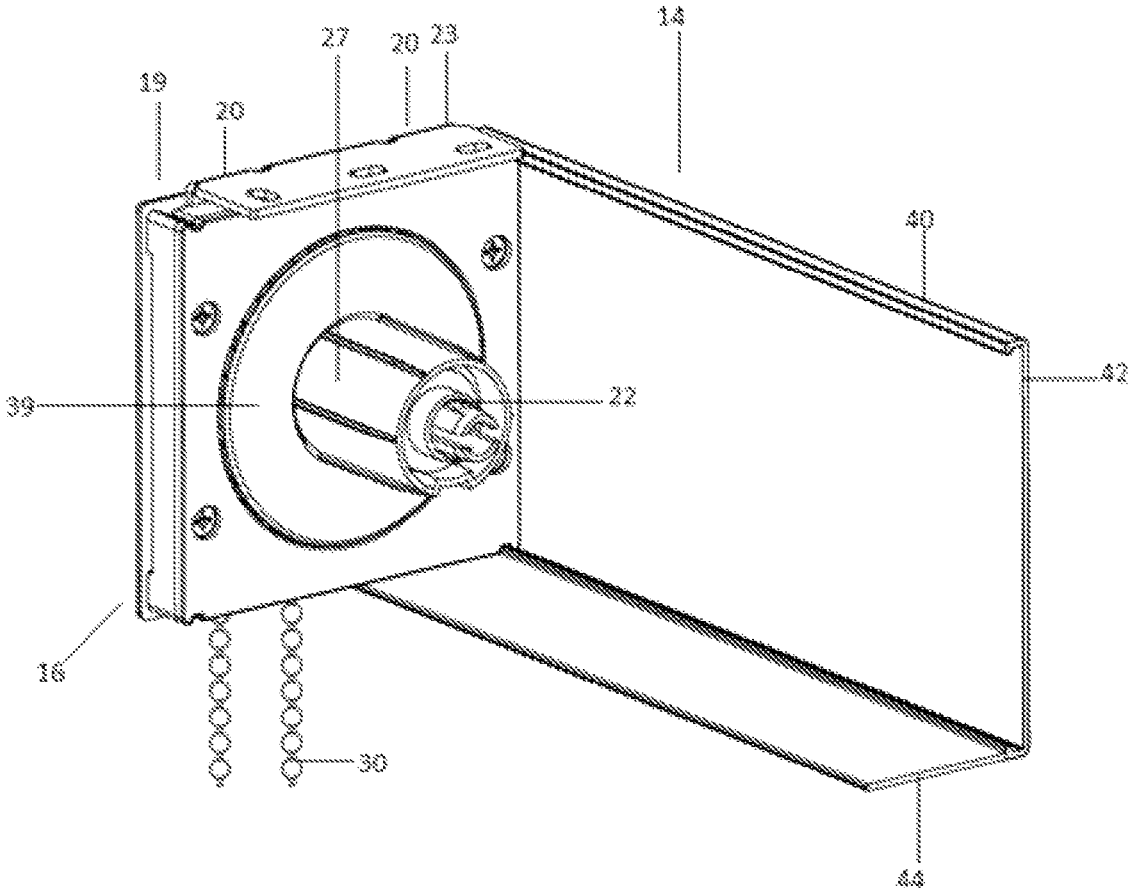
FIG. 3 is a perspective view in partial cutaway of a drive unit of a drive assembly of the embodiment of FIGS. 1 and 2, represented in assembled form.
Figure 4:
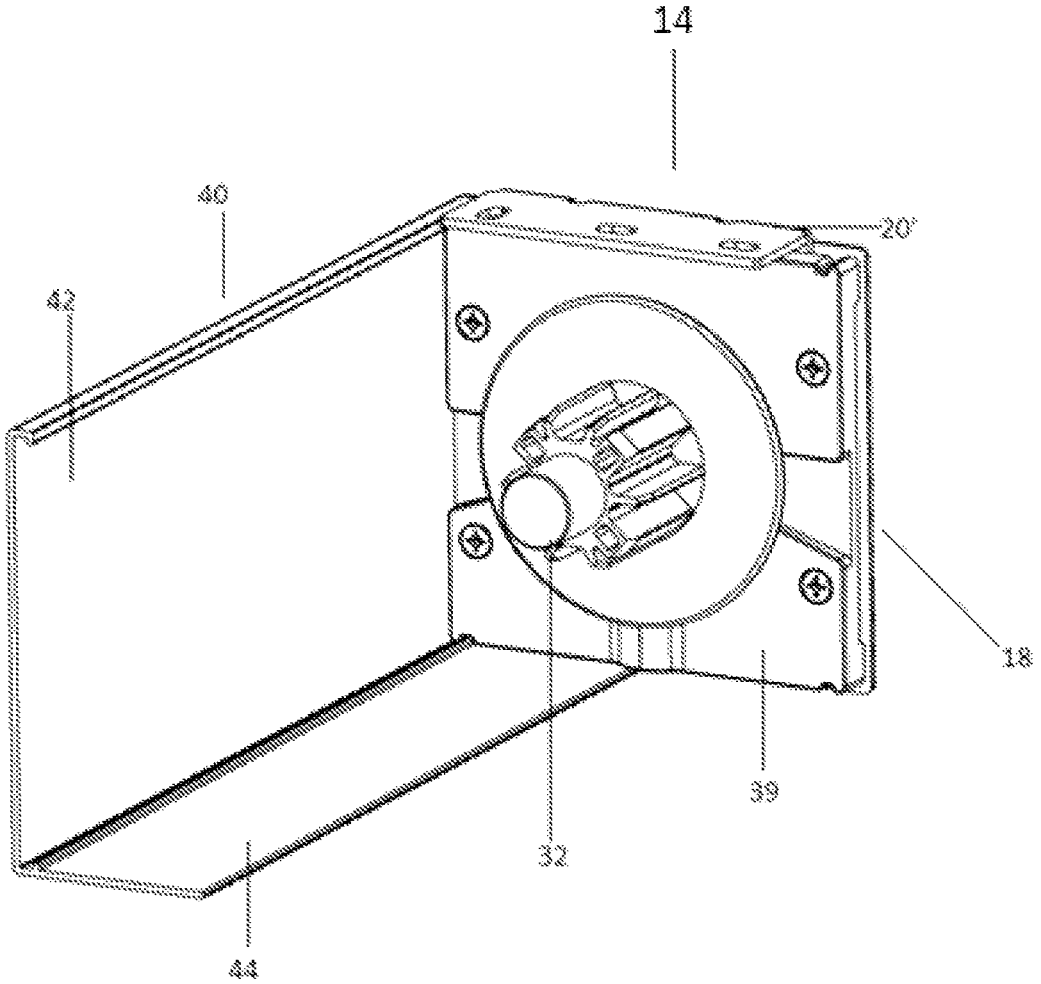
FIG. 4 is a perspective view in partial cutaway of an idler unit of the drive assembly of the present invention, represented in assembled form.
Figure 5:
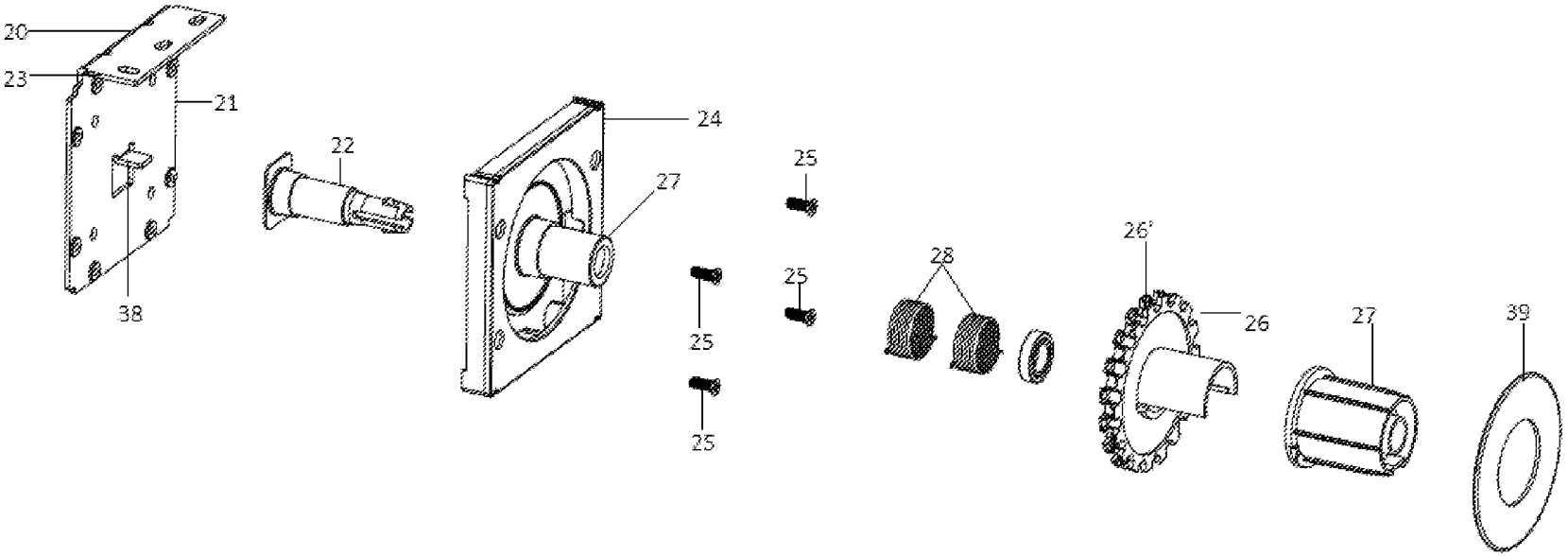
FIG. 5 is a perspective view in exploded form of the embodiment of FIG. 3.

With reference to FIGS. 3-5, the drive unit 16 is manually driven and is comprised of a clutch assembly 19 including a drive pin 22 and interface 2L to which the drive pin 22 is movably attached. Further, the interface 24 is fixedly secured to the corresponding bracket 20 by one or more screws or other appropriate connectors 25. In addition, a rotary disc 26 is connected in driving relation to a sheath or like sleeve member 27, which is surrounded by a cover plate 39 and is disposed within sleeve 27 into a fixed attachment to a corresponding end 12' (FIG. 2) of the shade mount 12 so as to facilitate rotation thereof upon activation of the drive unit 16 or clutch assembly 19, The clutch assembly 19 and drive unit 16 includes a pull cord/chain 30 mounted in driving relation to the rotary disk 26. As should be evident application of a manual force to the pull chain 30 in opposite directions causes a rotation of the rotary disk 26 and in turn a rotation of the shade mount 12 in opposite directions. The roller shade 100, being rolled upon the shade mount 12, is thereby raised and lowered. Additional features of the drive unit 16 and/or clutch assembly 19 include the outer periphery 26' of the rotary disk 26 being structured and configured to engage the pull cord/chain 30 to facilitate manual activation of the drive unit 16.

Figure 9:
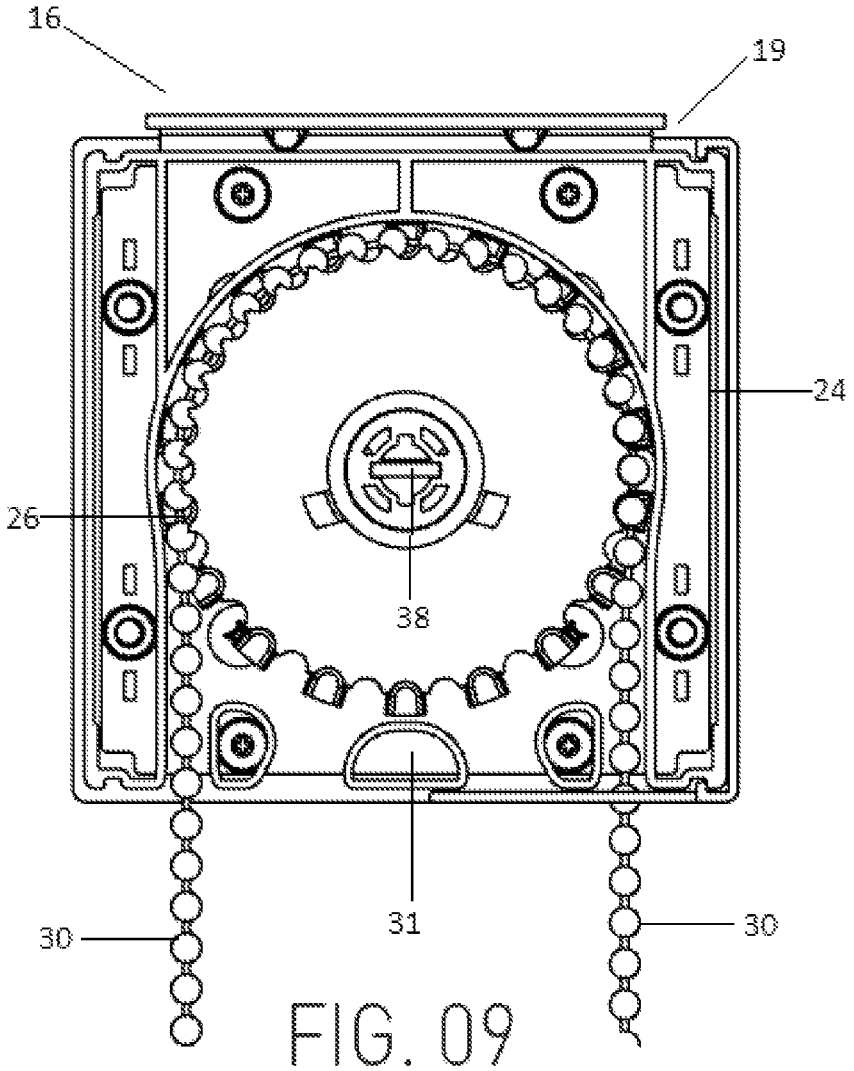
FIG. 9 is an elevation view of the embodiment of FIGS. 3 and 7 in an assembled form.
Figure 10:
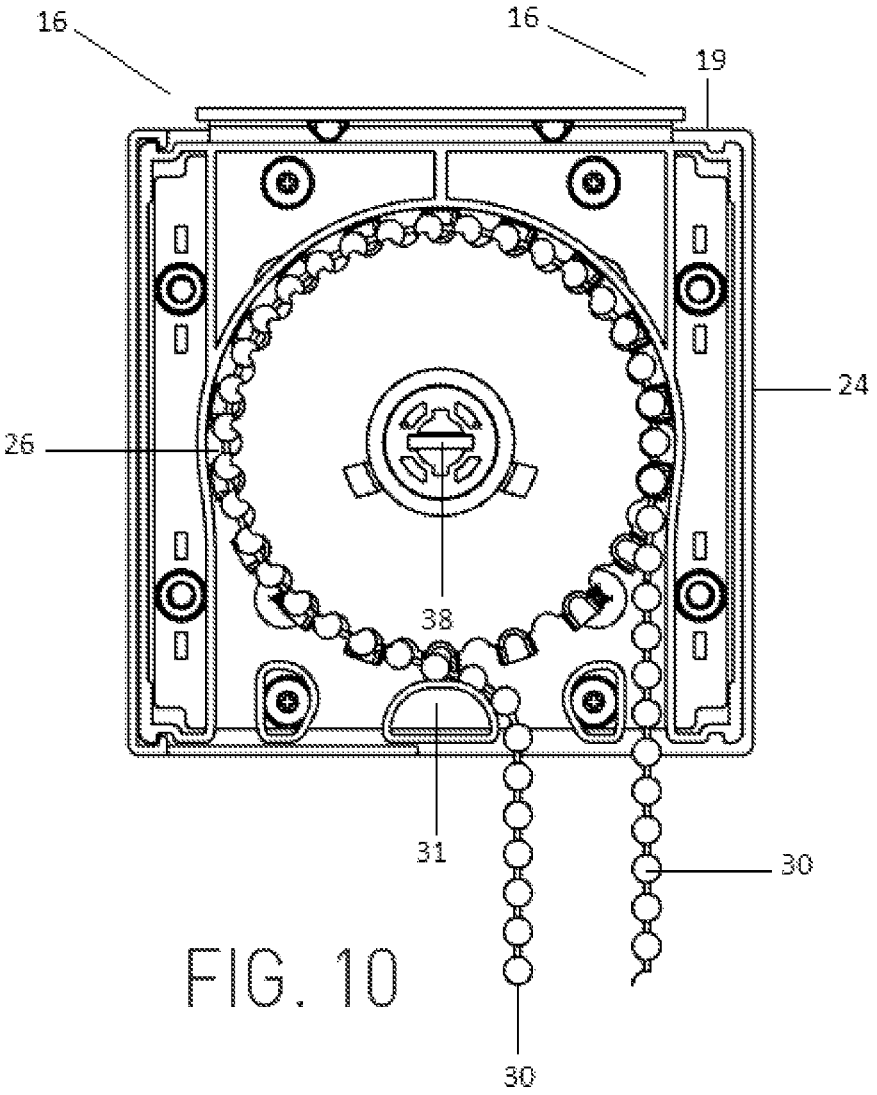
FIG. 10 is an elevation view of the embodiment of FIG. 9, representing a different mode of operation.
Figure 11:
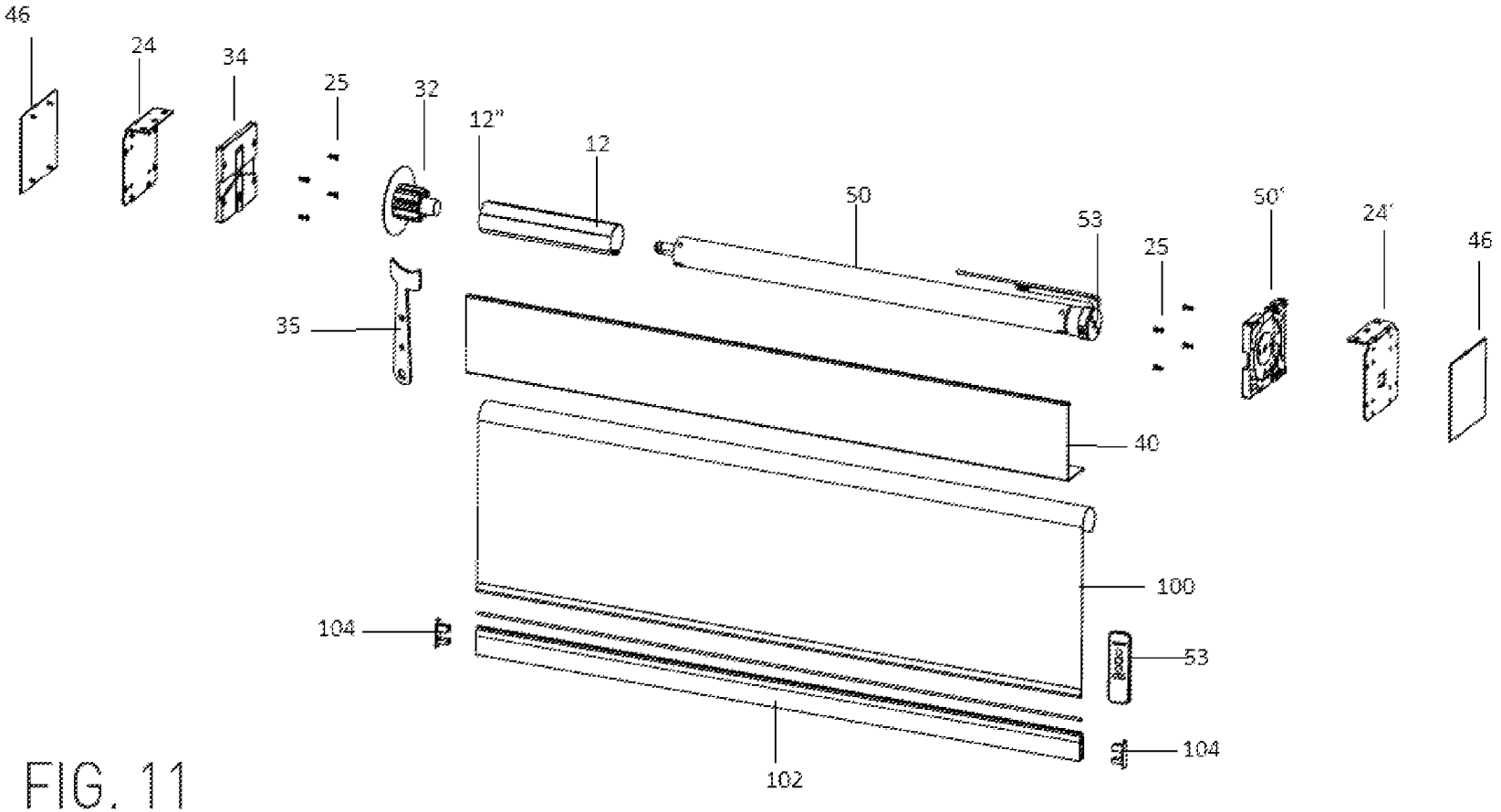
FIG. 11 is a perspective view in exploded form of another embodiment of the operating assembly for a roller shade of the present invention.

With further reference to the drive unit 16 and as represented in FIGS. 9 and 10, the clutch assembly 19 include a diverter structure 31 fixedly or integrally formed on the interface 24 in relation to the path of travel of the cord/chain 30. As such, the diverter structure 31 is disposed and structured to define an alternate path of the cord/chain 30 as it forces rotation of the rotary disk 26 in the either direction. More specifically, a conventional path of travel of the cord/chain 30 is represented in FIG. 9, wherein the cord is disposed on opposite peripheral sides of the rotary disk 26. However, in certain practical applications and installations it may be of benefit to divert the disposition of the cord/chain 30 to an alternate path of travel as represented in FIG. 10. Such an alternate path of travel comprises the cord/chain 30 being disposed adjacent the same or common side of the rotary disk 26, as it moves in either direction to rotate the rotary disk 26 and raise and lower the roller shade 100.

Figure 6:
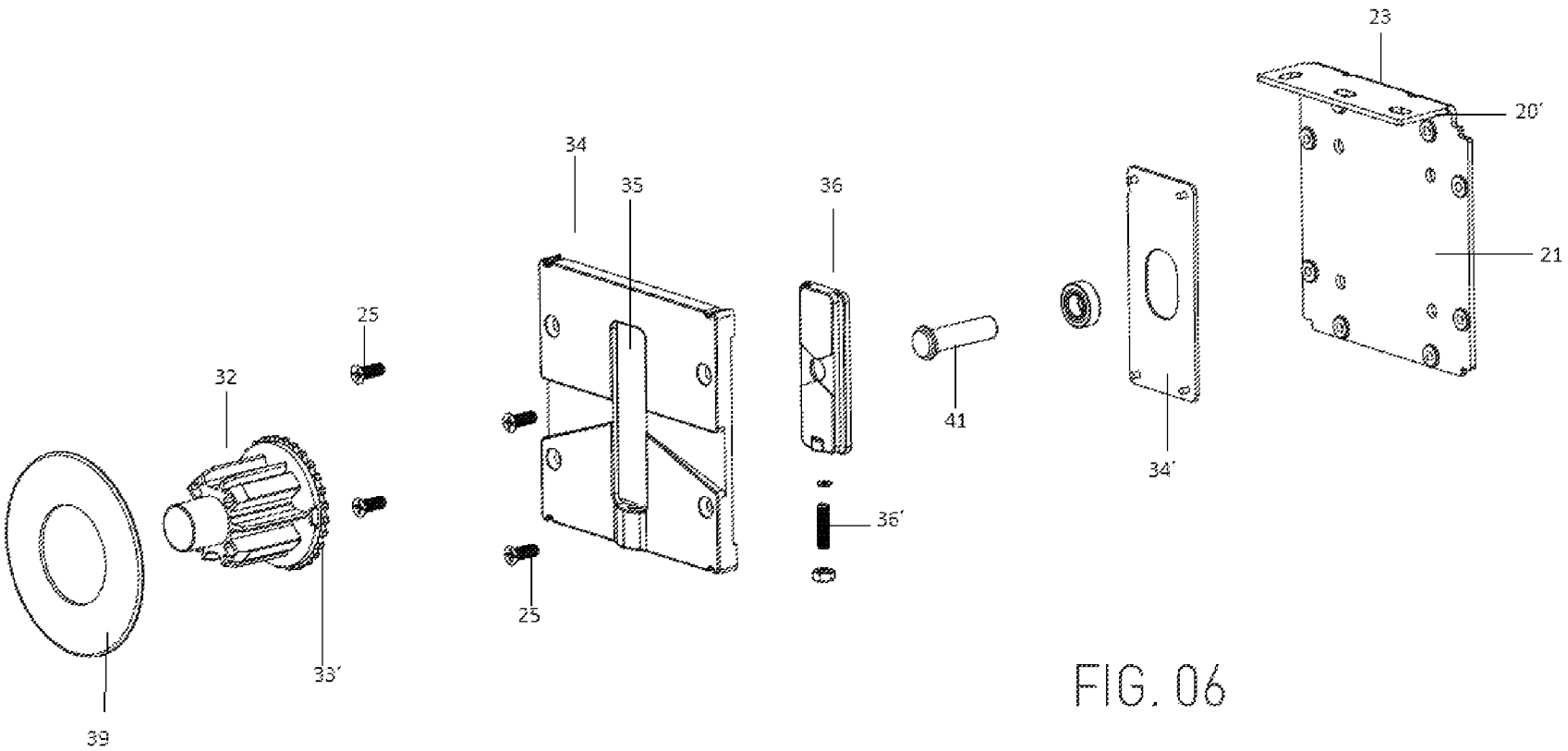
FIG. 6 is a perspective view in exploded form of the embodiment of FIG. 4.

As also represented in FIG. 5, the clutch assembly 19 includes a spring-biased construction comprising one or more biasing spring members 28 as clearly represented. Further, the drive pin 22 includes a "spring-loaded" construction structured to facilitate reciprocal disposition of the drive pin 22 relative to the shade mount. Such reciprocal disposition of the drive pin 22 occurs in a direction substantially coaxial to the length thereof and the length of the shade mount 12. As represented in FIG. 6, an adjustment member 33 is disposed and structured to regulate and/or determine the reciprocal disposition of the mounting pin 32. In at least one embodiment, the adjustment member 33 may have a predetermined irregular peripheral configuration 33' structured to facilitate manual engagement and attendant selective movement of the adjustment member 33 and the mounting pin 32 to accomplish a preferred reciprocal disposition, inward or outward relative to the shade mount 12. This may facilitate the attachment of the shade mount 12 concurrently to both the power unit 16 or 16', regardless of its type, and the idler unit 18. The irregular peripheral surface 33' of the adjustment member 33 may also facilitate the utilization of a common or customized tool 35 (see FIGS. 2 and 11) to engage and rotate/move the adjustment member 33 when manual engagement therewith is not practical or preferred.

As indicated herein, the drive assembly also includes the idler unit 18, represented in FIGS. 4 and 6 respectively in assembled and exploded form. The idler unit 18 is interconnected to a supporting surface via bracket 20' and includes a mounting pin 32, surrounded by cover plate 39 fixedly secured to a corresponding end 12" (FIG. 2) of the shade mount 12. Further, the idler unit 18 includes an interface generally indicated as 34 and 34' fixedly secured to the bracket 20' by one or more screws or like connectors 25. In addition, a leveling assembly 36 is included in and may be considered a component of the idler unit 18. The leveling assembly 36 is operative to regulate and establish a substantially level disposition of the assembled operating assembly 10 and/or 10' relative to a supporting surface. More specifically, the leveling assembly 36 includes an adjustment connector 36' which is connected to and serves to at least minimally raise or lower the mounting pin 32 and the correspondingly attached end 12" of the shade mount 12. The leveling feature is further facilitated by member 41 disposed on the interior of mounting pin 32 and movable in a reciprocal manner, in opposite directions within elongated slot or channel 35 of the interface 34. Moreover, the adjustment connector 36' may have an externally threaded configuration manually manipulated by rotation thereof by an appropriate tool to effectively raise or lower the interface 34 and the attached mounting or mounting pin 32, via the leveling assembly 36 being connected to the pin member 41 causing it to move in either direction within slot 35 upon adjustment of the adjustment connector 36'. As noted, the interface 34 may be fixedly secured to the bracket 20'. However, a portion of the leveling assembly 36, is attached to and movable with the mounting pin 32 through channel 35 in the interface 34. Therefore, rotation of the adjustment connector 36' in opposite directions will serve to at least minimally raise or lower the pin member 41 within slot 35 and in turn raise or lower the mounting pin 32 as well as the end 12" of the shade mount 12 to which the mounting pin 32 is attached. The substantially level disposition of the assembled operating assembly 10 and 10' is accomplished by an adjustment of the assembled operating assembly 10 and 10' in a substantially vertical direction, in the manner set forth above. Such an initial non-level disposition of the installed operating assembly 10 and 10' may be due, at least in part, to a ceiling or other horizontally oriented support surface itself not being truly level or horizontal as normally intended.

As represented throughout the Figures, the bracket assembly includes the aforementioned two brackets 20 and 20' disposed in interconnecting relation between opposite ends 12' and 12" of the shade mount 12 and a supporting surface, as represented in FIGS. 1-10. Each of the aforementioned preferred embodiments of the present invention include the bracket assembly including at least two brackets 20 and 20' is interconnected to a different one of the drive unit 16 and idler unit 18, which in turn are operatively attached to the different ends 12 and 12' of the shade mount 12. Either a manual or electrically powered drive assembly is interconnected between the bracket assembly and the shade mount 12 in rotationally driving relation to the shade mount 12, as described in greater detail hereinafter.

The bracket assembly, including each of the at least two oppositely disposed brackets 20 and 20' are structured to assume variable operative orientations as they support opposite ends 12 and 12' of the shade mount 12 and operatively interconnect the drive unit 16, 16' and the idol unit 18 to the shade mount 12. More specifically, the variable operative orientations of the bracket assembly and the aforementioned oppositely disposed brackets 20 and 20' include the shade mount 12 or 12' being supported by and interconnected to differently oriented support surfaces, typically disposed in perpendicular and/or transverse relation to one another. By way of nonlimiting example, the variable orientations of the brackets 20 and 20' of the bracket assembly include their supporting engagement with either a substantially horizontal ceiling surface or a substantially vertical wall surface (not shown for purposes of clarity). As explained in greater detail with primary reference to FIGS. 7-8, this is accomplished by changing or reorienting the disposition of both the two oppositely disposed brackets 20 and 20' substantially 90°, such that an attachment segment 23 thereof assume a substantially horizontal orientation or substantially vertical orientation.

Figure 7:
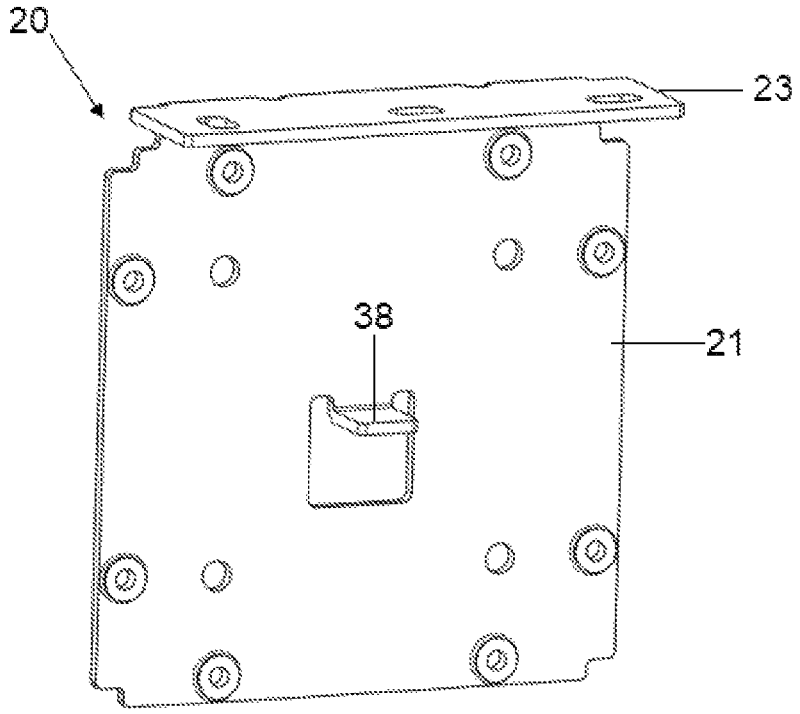
FIG. 7 is a perspective view of one of a plurality of at least two brackets, of a bracket assembly of the present invention, disposed in one of a plurality of variable operative orientations.
Figure 8:
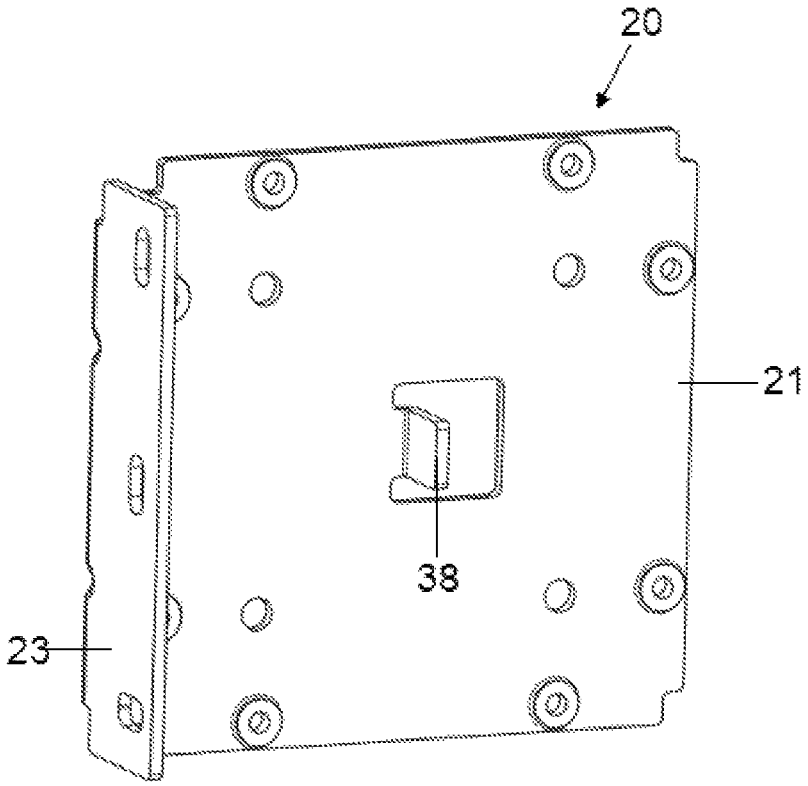
FIG. 8 is a perspective view of the embodiment of FIG. 7, disposed in a different one of a plurality of variable operative orientations, from that represented in FIG. 7.

Therefore, as represented in FIGS. 7 and 8, each of the oppositely disposed brackets 20 and 20' of the bracket assembly include a base 21 and an attachment segment 23 disposed in transverse and/or perpendicular relation to one another. The base 21 of each of the two brackets 20 and 20' is dimensioned and configured to be fixedly secured to different ones of the aforementioned drive unit 16 and idler unit 18, by the aforementioned screws or other type connectors. The attachment segment 23, dependent on the orientation/position of the bracket 20 or 20' to which it is attached, will be secured to one of transversely oriented supporting ceiling or wall surfaces. Therefore, when the operating assembly 10 or 10' is intended to be connected to and supported by a wall surface rather than a ceiling surface, the bracket is effectively rotated 90° as represented in FIG. 8, such that the attachment segment 23 is disposed in a substantially vertical orientation.

In such a variable operative orientation, the attachment segment 23 of each bracket 20 and 20' will be disposed in direct confronting engagement with a substantially vertically oriented wall surface. However, when it is intended to install the operating assembly 10 and 10' to a substantially horizontally oriented ceiling surface, the brackets 20 and 20' are rotated and/or reoriented 90°, from that represented in FIG. 8 to that represented in FIG. 7. In such a variable operative orientation, the attachment segment 23 assumes a substantially horizontal orientation. It is to be noted that the ceiling and wall surfaces are not meant to be described herein as being disposed in a true horizontal or vertical orientation. Further, the term "ceiling surface" is meant to describe the surface serving as the interior ceiling of a room or area. In the alternative, this term may also be descriptive of the substantially horizontal surface on the interior of a window casing.

As set forth above, different preferred embodiments of the operating assembly 10 and 10' of the present invention accomplish raising and lowering of the roller shade by either a manual drive or an electrically powered rotational drive of the shade mount 12. As also indicated, the manual drive includes the drive unit 16 being in the form of a manual clutch assembly 19 operatively interconnected to a pull cord/chain 30 connected in driving engagement to the rotating disk 26. In contrast, the electrically powered embodiment of the operating assembly 10', described in greater detail with reference to FIGS. 11-13, includes an electric drive motor 50 connected to the shade mount 12 and having a corresponding end thereof 50' connected to an interface unit 24'. The interface unit 24' is fixedly connected to at least one of the correspondingly positioned brackets 20, as represented in FIGS. 7-8.

Figure 12:
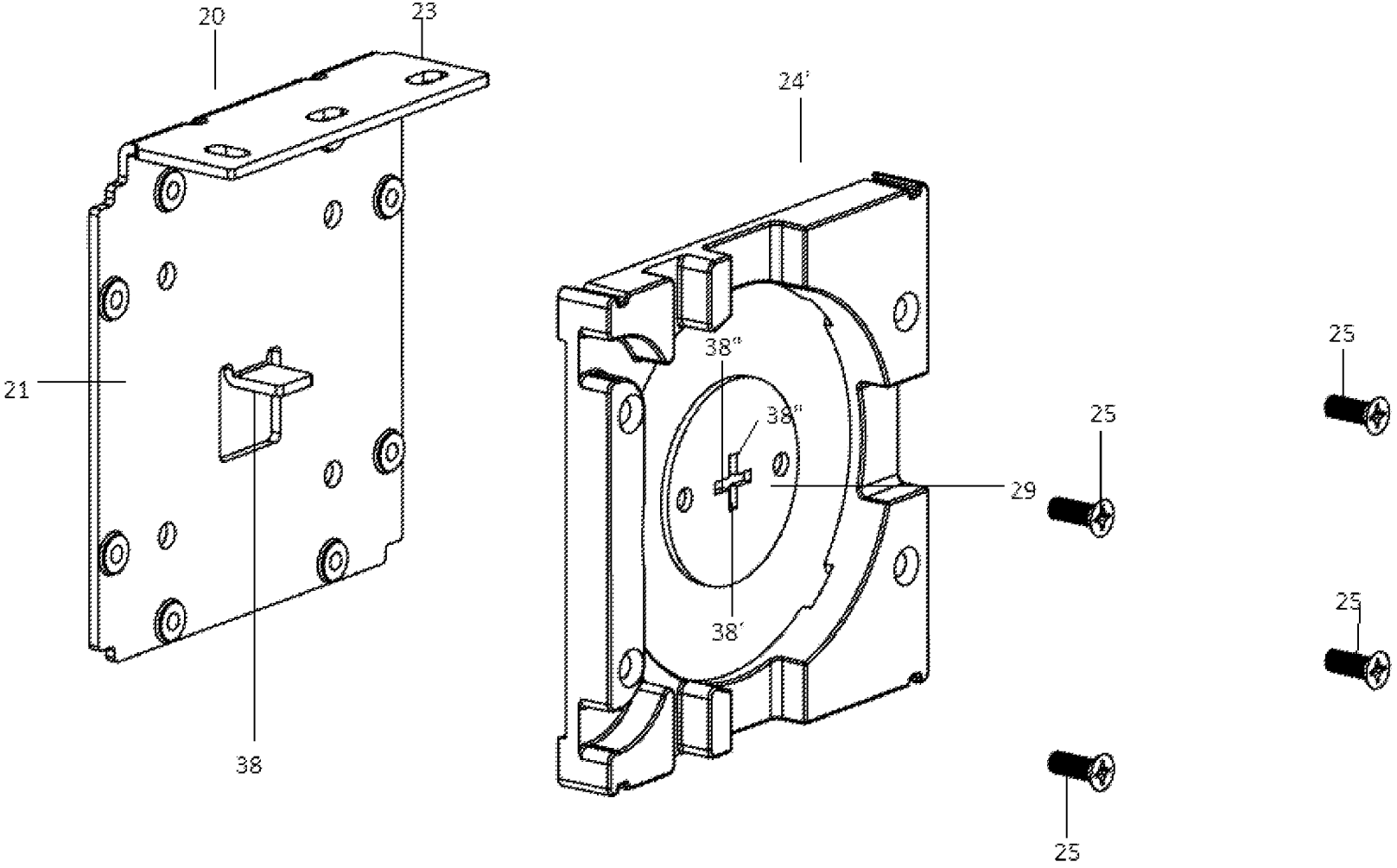
FIG. 12 is a perspective view in exploded form of a drive unit of the drive assembly associated with the embodiment of FIG. 11.
Figure 13:
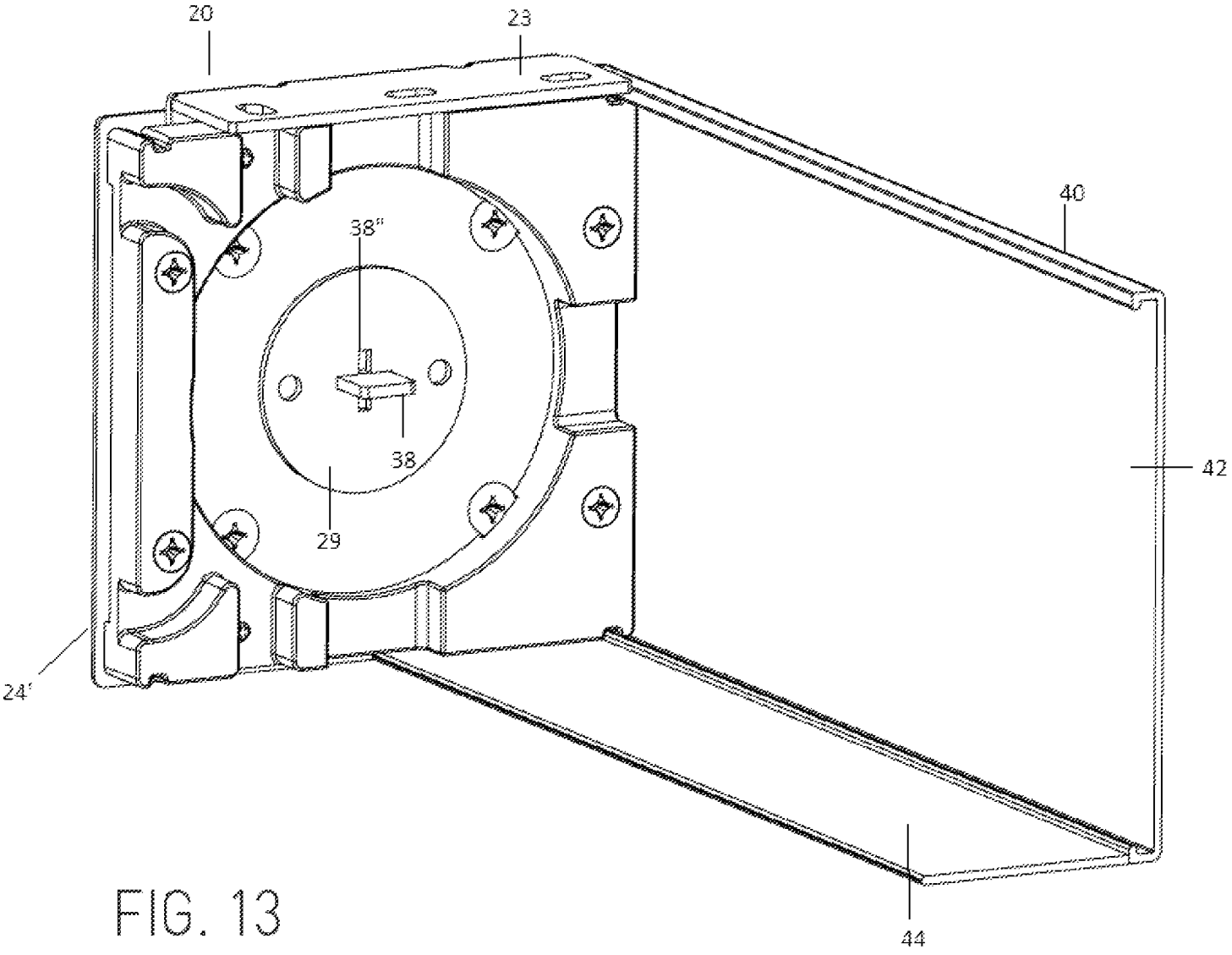
FIG. 13 is a perspective view in partial cutaway and assembled form of the drive unit of the embodiment of FIG. 12.

With primary reference to FIGS. 11-13 and as set forth herein, the shade mount 12 and attached roller shade 100 may be rotationally driven by an electrically powered motor 50 operatively associated with and/or at least partially defining the drive unit 16'. Accordingly, the drive unit 16' is structured to interconnect a corresponding end 50' of the motor 50 to the supporting bracket 20, which in turn is secured to either one of typically transversely oriented supporting surfaces (ceiling and wall surfaces). More specifically, an interface 24' is structured to interconnected the drive motor 50, via the end 50' to the bracket 20. As such, the interface 24' includes an aperture 38' disposed and structured to receive the outwardly protruding mounting tab 38, As represented, the aperture 38' preferably includes a "cross-like" configuration or other appropriate configuration which allows the mounting tab 38 to be placed in either of the transversely oriented slots 38". The transverse orientation of the slots 38" facilitates the orientation and mounting of the brackets 20 and 20' on correspondingly oriented support surfaces (ceiling or wall) in substantially perpendicular or transverse relation to one another. In turn, the assembly 10 and 10' can also be correspondingly mounted. As also indicated, the interface 24' fixedly secured to the bracket 20 by a plurality of screws or other appropriate connectors 25 as represented in FIG. 12. In addition, as represented in FIGS. 12-13 the interface 24' includes an connecting segment 29 disposed, structured and configured to engage the corresponding end 50' of the electric drive motor 50.

As also represented in FIG. 11 the drive motor 50 may be remotely controlled and include appropriate antenna 53. Accordingly, a wireless remote control device 53 may be operatively associated with the operating assembly 10' for reciprocal rotation of the shade mount 12 and roller shade 100, facilitating its raising and lowering.

Therefore, one distinguishing feature of the present invention is the inclusion of the at least one bracket 20 of the two oppositely disposed brackets 20 and 20' being structured to be interconnected to either of the drive units 16 and/or 16' and therefore may be operatively, associated the aforementioned manually driven clutch assembly 19 or electric drive motor 50, respectively. As a result, the dimensioning, configuring and overall structuring of the one bracket 20 facilitates its accommodation in supporting interconnection between either of the different types of drive unit 16 and 16' and the support and attachment thereof to either one of typically transversely oriented supporting ceiling or wall surfaces. Accordingly, the versatile structuring of the at least one bracket 20 includes a mounting tab 38 fixedly and/or integrally secured to the base 21 of the bracket 20 and extending transversely outward there from into supporting engagement with either of the different type drive units 16 and 16' respectively including the manual clutch 19 or electric motor 50.

While the aforementioned drive units 16 and 16' may be of different types by being manually or electrically powered, another advantageous distinguishing feature of the operating assembly 10 and 10' of the present invention is the universal structuring of the idler unit 18 facilitating its use with either of the different types of drive units 16 and 16' and shade mount 12 represented in FIGS. 2 and 11. As such, the idol unit 18 comprises the mounting pin 32 disposed in fixed engagement and rotational with the corresponding end 12" of the different shade mounts 12, as represented in FIGS. 2 and 11.

Yet additional features structurally and operatively associated with each of the embodiments of the operating assembly 10 and 10' include the provision of at least a frontal fascia 40. The frontal fascia 40 preferably includes a generally L-shaped configuration including a vertically oriented exposed surface 42 overlying the front portion of the assembled operating assembly 10 and 10'. In addition, the L-shaped configuration includes a transverse and/or perpendicular bottom segment 44 disposed in overlying, covering relation to a normally exposed bottom area of the assembled operating assembly 10 and 10'. Further, end covers 44 may be disposed in overlying, covering relation to opposite ends of the operating assembly 10 and 10' by attachment to the frontal and or rear fascia 40 and 48.

It is to be noted that in certain practical installations, a "blackout" condition may be desired, wherein the passage of external light into the interior of the portal, about peripheral portions of the corresponding roller shade 100 and operating assembly 10 and 10' is blocked or at least partially restricted. Such a "blackout" condition may be at least partially accomplished through the provision of a rear fascia 48 cooperatively disposed with the frontal fascia 40 to at least partially enclose the operating system 10 and 10' about at least three sides thereof. The operative and structural features associated with both the frontal fascia 40 and rear fascia 48 allows their "snap-fit" construction into intended positions, in at least partially surrounding and/or enclosing relation to the installed operating system 10 and 10' as at least partially represented in FIG. 2.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An operating assembly for a roller shade comprising:

a shade mount movably connected to the roller shade between lowered and raised orientations thereof, a bracket assembly, including two brackets, at least one of said two brackets including a mounting tab extending outwardly therefrom, each bracket disposed in interconnecting relation between a different opposite end of said shade mount and a supporting surface, a drive assembly interconnected between said bracket assembly and said shade mount in rotationally driving relation to said shade mount, said drive assembly including a drive unit and an idler unit each rotationally connected to a different one of said opposite ends of said shade mount, each of said two brackets structured for collective positioning in different operative orientations, each of said different operative orientations comprising said two brackets connected to a common one of different transversely disposed supporting surfaces, an interface interconnecting said at least one bracket to said drive unit, said interface including an aperture, said aperture including two slots disposed in transverse, communicating relation to one another, and said mounting tab of said at least one bracket disposed in a different one of said two slots, dependent on to which of the two transversely disposed supporting surfaces, said at least one bracket is connected.

2. The operating assembly as recited in claim 1 wherein comprises each of said two brackets includes a base and an attachment segment disposed in transverse relation to one another.

3. The operating assembly as recited in claim 2 wherein each of said different operative orientations comprises said attachment segment secured directly to a different, common one of the transversely disposed supporting surfaces; said at least one of said two brackets structured for supporting interconnection of said shade mount with different types of drive units.

4. The operating assembly as recited in claim 1 wherein said drive unit comprises a manual drive; clutch assembly.

5. The operating assembly as recited in claim 4 wherein said clutch assembly is fixedly connected to said at least one bracket and attachable therewith to one of the transversely disposed supporting surfaces; said clutch assembly removably connected in driving relation to one end of said shade mount.

6. The operating assembly as recited in claim 1 wherein said drive unit comprises an electrically powered drive motor.

7. The operating assembly as recited in claim 1 wherein said drive unit comprises a clutch assembly including a diverter structure, a pull cord connected in driving engagement with said clutch assembly, said diverter structure disposed and structured to define an alternate path of travel of said pull cord concurrent to said driving engagement and movement of the roller shade between the lowered and raised orientations.

8. The operating assembly as recited in claim 1 wherein said drive unit comprises a drive pin disposable in rotating engagement with a correspondingly positioned end of said shade mount; said drive pin comprising a spring-loaded construction structured to facilitate reciprocal disposition of said drive pin relative to said correspondingly positioned shade mount.

9. The operating assembly as recited in claim 1 further comprising an adjustment member connected to said idler unit and disposed and structured to regulate disposition of a mounting pin of said idler unit relative to said shade mount; said adjustment member having a predetermined peripheral configuration structured to facilitate manual regulation of said disposition of said idler unit.

10. The operating assembly as recited in claim 9 further comprising a leveling assembly connected to said mounting pin; said leveling assembly operative to regulate a vertical, level disposition of said mounting pin and shade mount, concurrent to interconnection therebetween.

11. The operating system as recited in claim 1 further comprising a frontal fascia disposed in at least partially covering relation to said shade mount, bracket assembly and drive assembly.

12. The operating system as recited in claim 11 wherein said frontal fascia comprises a substantially L-shaped configuration concurrently disposed in at least partially covering relation to frontal and under portions of said shade mount, bracket assembly and drive assembly.

13. An operating assembly for a roller shade comprising:

a shade mount rotationally connected to the roller shade concurrent to movement thereof between lowered and raised orientations, a bracket assembly disposed in interconnecting relation between opposite ends of said shade mount and a common supporting surface, a drive assembly interconnected between said bracket assembly and said shade mount in rotationally driving relation to said shade mount, said drive assembly including a drive unit and an idler unit each rotationally connected to a different one of said the opposite ends of said shade mount, said bracket assembly comprising at least one bracket disposed in supporting interconnection between said drive unit and a supporting surface and structured for said supporting interconnection with different types of said drive unit, and said at least one bracket includes a mounting tab extending outwardly therefrom in supporting engagement with an operatively positioned one of said different types of said drive unit, an interface interconnecting said at least one bracket to said drive unit, said interface including an aperture, said aperture including two slots disposed in transverse, communicating relation to one another, and said mounting tab of said at least one bracket disposed in a different one of said two slots, dependent on which of two transversely disposed supporting surfaces, said at least one bracket is connected.

14. The operating system as recited in claim 13 wherein said different types of said drive unit include a manual drive, clutch assembly.

15. The operating assembly as recited in claim 14 wherein said clutch assembly is fixedly connected to said at least one bracket and attachable therewith to the support surface; said clutch assembly removably connected in driving relation to one of said opposite ends of said shade mount.

16. The operating assembly as recited in claim 13 wherein said different types of said drive unit include an electrically powered drive motor.

* * * * *